US005921127A

United States Patent [19]

Ogawa et al.

[11] Patent Number: 5,921,127

[45] Date of Patent: Jul. 13, 1999

[54] HOT STRIP ROLLING MILL

[75] Inventors: Shigeru Ogawa; Toshio Kikuma; Tsuyoshi Higo; Noriyuki Suzuki, all of Futtsu, Japan

[73] Assignee: Nippon Steel Corporation, Tokyo, Japan

[21] Appl. No.: 08/913,203

[22] PCT Filed: Jan. 8, 1997

[86] PCT No.: PCT/JP97/00014

§ 371 Date: Sep. 4, 1997

§ 102(e) Date: Sep. 4, 1997

[87] PCT Pub. No.: WO97/25164

PCT Pub. Date: Jul. 17, 1997

[30] Foreign Application Priority Data

Jan. 8, 1996 [JP] Japan ..... 8-018322
Jan. 22, 1996 [JP] Japan ..... 8-027271

[51] Int. Cl.[6] ..... B21B 27/06

[52] U.S. Cl. ..... 72/201

[58] Field of Search ..... 72/200, 201, 210, 72/222, 236, 227, 250, 251, 252, 228, 229

[56] References Cited

U.S. PATENT DOCUMENTS 3,811,305 5/1974 Saylor, Jr. ..... 72/201
3,913,369 10/1975 Field et al. ..... 72/201
5,276,952 1/1994 Thomas et al. ..... 72/202

FOREIGN PATENT DOCUMENTS 49-61557 6/1974 Japan .
55-28086 2/1980 Japan .
2-25214 1/1990 Japan .
5-317963 12/1993 Japan .
7-204723 8/1995 Japan .
2537299 7/1996 Japan .

*Primary Examiner*—Joseph J. Hail, III
*Assistant Examiner*—Rodney Butler
*Attorney, Agent, or Firm*—Kenyon & Kenyon

[57] ABSTRACT

A hot strip rolling mill comprises a strip front-end arresting device arranged between the finishing mill and the down-coiler, and the strip front-end arresting device holds a front-end of the strip and moves from an exit of the finishing mill to the down-coiler at high speed while it gives a tension to the strip. Pinch rollers and cooling water spraying devices composing the strip cooling line are capable of moving in the upper and the lower direction with respect to the strip surface in accordance with the movement of the strip front-end arresting device. Further, the hot strip rolling mill comprises an auxiliary drive device for giving an initial acceleration to the strip front-end arresting device, and/or a strip edge portion holding device for easily transferring the front-end of the hot strip from the strip front-end arresting device to the down-coiler.

8 Claims, 11 Drawing Sheets

HOT STRIP ROLLING MILL

TECHNICAL FIELD

The present invention relates to a hot strip rolling mill. More particularly, the present invention relates to a strip cooling line arranged between a hot finishing mill and a coiler on a hot strip rolling line.

In a hot strip rolling mill, a strip is hot-rolled by a finishing mill to a predetermined thickness and coiled by a down-coiler. In the hot strip rolling mill, there is provided a strip cooling line between the finishing mill and the down-coiler. While the strip runs on the strip cooling line, it is cooled to a predetermined coiling temperature. This strip cooling line includes a run-out table composed of hundreds of motor-driven rollers and a water spray type cooling device or a laminar flow type water cooling device. The strip is cooled as follows. A lower surface of the strip conveyed on the run-out table is cooled by cooling water sprayed from among the rollers of the run-out table, and an upper surface of the strip conveyed on the run-out table is cooled by cooling water sprayed from an upper portion of the run-out table.

In this connection, when the strip is conveyed at high speed on the above roller table type run-out table, a front-end of the strip tends to fly upward, that is, a flying phenomenon may occur. When the flying phenomenon occurs, it is difficult for the strip front-end to be smoothly guided into the down-coiler. In order to prevent the occurrence of the above flying phenomenon, it is necessary to maintain the conveyance speed of the strip at about 700 m/min until the strip front-end is wounded round the mandrel of the down-coiler. Therefore, it is difficult to fully utilize the full capacity (the maximum capacity is approximately 1500 m/min) of the finishing mill at all times, which reduces the productivity.

In order to prevent the occurrence of the above problems, Japanese Examined Patent Publication No. 2-25214 discloses a technique in which the strip is attracted onto the run-out table by an electromagnetic force. However, the intensity of an electromagnetic force is in inverse proportion to the square of a distance. Therefore, when flying occurs for some reason such as a disturbance, it is very difficult to attract the flying strip front-end onto the run-out table again. Accordingly, the above technique is not sufficient to realize high-speed conveyance of the strip on the roller table while the front-end of the strip is prevented from flying upward.

Japanese Unexamined Patent Publication No. 7-204723 discloses a device in which a guide plate to suppress a curl of the strip front-end is arranged in a carriage that runs in conjunction with a strip sent out from a finishing mill. However, this device has no function to pull the strip front-end. Therefore, it is impossible to prevent the occurrence of a defective flatness of the strip in the process of cooling.

DISCLOSURE OF THE INVENTION

It is an object of the present invention to provide a highly efficient hot strip rolling mill in which the occurrence of a flying phenomenon of a strip front-end can be prevented when the strip is conveyed on the run-out table at high speed, so that the threading performance of the finishing mill is not deteriorated.

It is another object of the present invention to decrease the coiling time after the completion of hot-finishing and reduce the equipment cost by shortening the length of the run-out table.

A feature of the hot strip rolling mill of the present invention is to include a strip front-end arresting device arranged on the strip cooling line between the finishing mill and the down-coiler, so as to hold a strip front-end and move it from the exit of the finishing mill to the down-coiler.

Other feature of the strip cooling line is to include a pinch roller and a cooling water spraying device which can be retracted from the path of the strip front-end arresting device while the strip front-end arresting device passes on the strip cooling line, and in which, after the strip front-end arresting device has passed, the pinch roller and the cooling water spraying device are made to come close to an upper and a lower surface of the strip. The other feature of the strip cooling line also is to include an electromagnetic force generating means for generating an electromagnetic force to make a strip front-end run stably on the strip cooling line, a fluid spraying device or an electromagnetic force generating device so as to introduce a strip front-end into the entrance of the down-coiler, which is arranged immediately before the down-coiler, and a looper device for temporarily reducing a moving speed of the strip front-end.

Other feature of the hot strip rolling mill of the present invention is to include an auxiliary drive device for giving an initial acceleration to the strip front-end arresting device, wherein the auxiliary drive device is arranged between the guide rails to guide the strip front-end arresting device, and is to establish a strip edge holding device for holding strip edges to the strip front-end arresting device so as to easily transfer the hot strip front-end from the strip front-end arresting device to the down-coiler.

By the above devices, it is possible to convey a hot strip at high speed, which strip has been sent out from the hot finishing mill, on the run-out table, the length of which is shortened, while a tension of predetermined intensity is preferably given to the hot strip and the hot strip is cooled quickly, without the occurrence of a flying phenomenon of the strip front-end.

BEST MODE FOR CARRYING OUT THE INVENTION

While referring to the accompanying drawings, an example of the present invention will be explained below.

Figure 1:
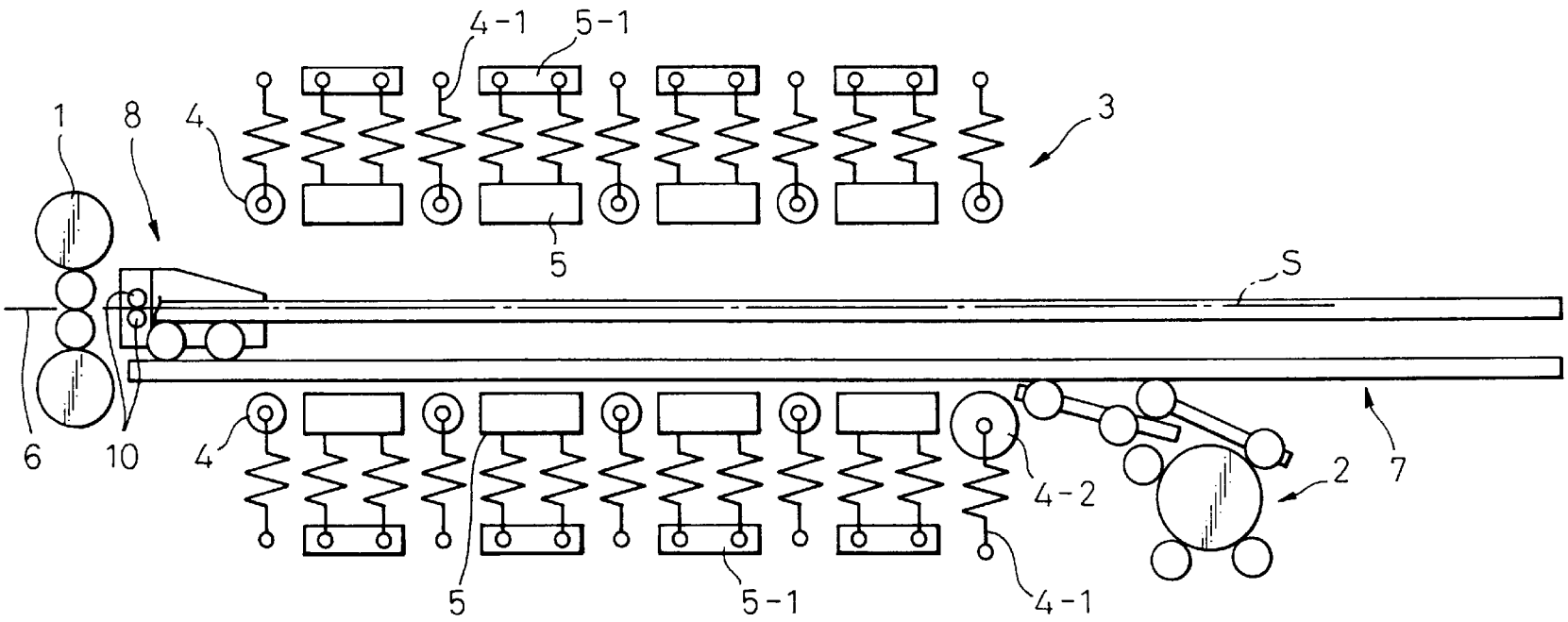
FIG. 1 is a front view showing an outline of the hot strip rolling mill of the present invention in a state before threading a strip onto a strip cooling line.

As illustrated in FIG. 1, on the delivery side of the final rolling stand of the finishing mill 1, there are provided a strip cooling line 3, and upper and lower guide rails 7 to guide a strip front-end arresting device 8. Further, on the delivery side of the strip cooling line 3, there is provided a down-coiler 2.

The strip cooling line 3 includes a large number of pairs of pinch rollers 4 arranged in the threading direction at appropriate intervals, wherein each pair of pinch rollers is composed of an upper pinch roller and a lower pinch roller, and a plurality of cooling water spraying devices 5. These pinch rollers 4 and cooling water spraying devices 5 are alternately arranged in the threading direction.

The pair of pinch rollers 4 is composed of an upper pinch roller and a lower pinch roller, and the respective pinch rollers can be moved upward and downward. These pinch rollers are supported by drive units 4-1. Each pair of pinch rollers pinches an upper and a lower surface of the hot strip 6 sent out from the finishing mill 1 with a predetermined pressure, so that a predetermined drive force is given to each pair of pinch rollers, and the rotational speed of each pinch roller can be freely controlled. In this connection, the drive mechanisms of the pinch rollers are not illustrated in the drawings. The cooling water spraying device 5 is composed of a pair of cooling water spraying devices, wherein the pair of cooling water spraying devices are composed of an upper cooling water spraying device and a lower cooling water spraying device, as the same as the pinch rollers 4. The cooling water spraying devices 5 are arranged in such a manner that they can be brought close to and separated from the upper and the lower surface of the strip 6 by the action of drive units 5-1. There is provided a plurality of cooling nozzles on a surface of each cooling water spraying device 5 opposing to the strip 6, so that cooling water can be sprayed from the cooling nozzles onto the upper and the lower surface of the strip 6.

On the strip cooling line 3, there are provided guide rails 7 which are extended in the threading direction. On these guide rails 7, there is arranged a strip front-end arresting device 8 which runs on the guide rails 7 while it is holding a front-end of the strip 6 sent out from the finishing mill 1.

Figure 2:
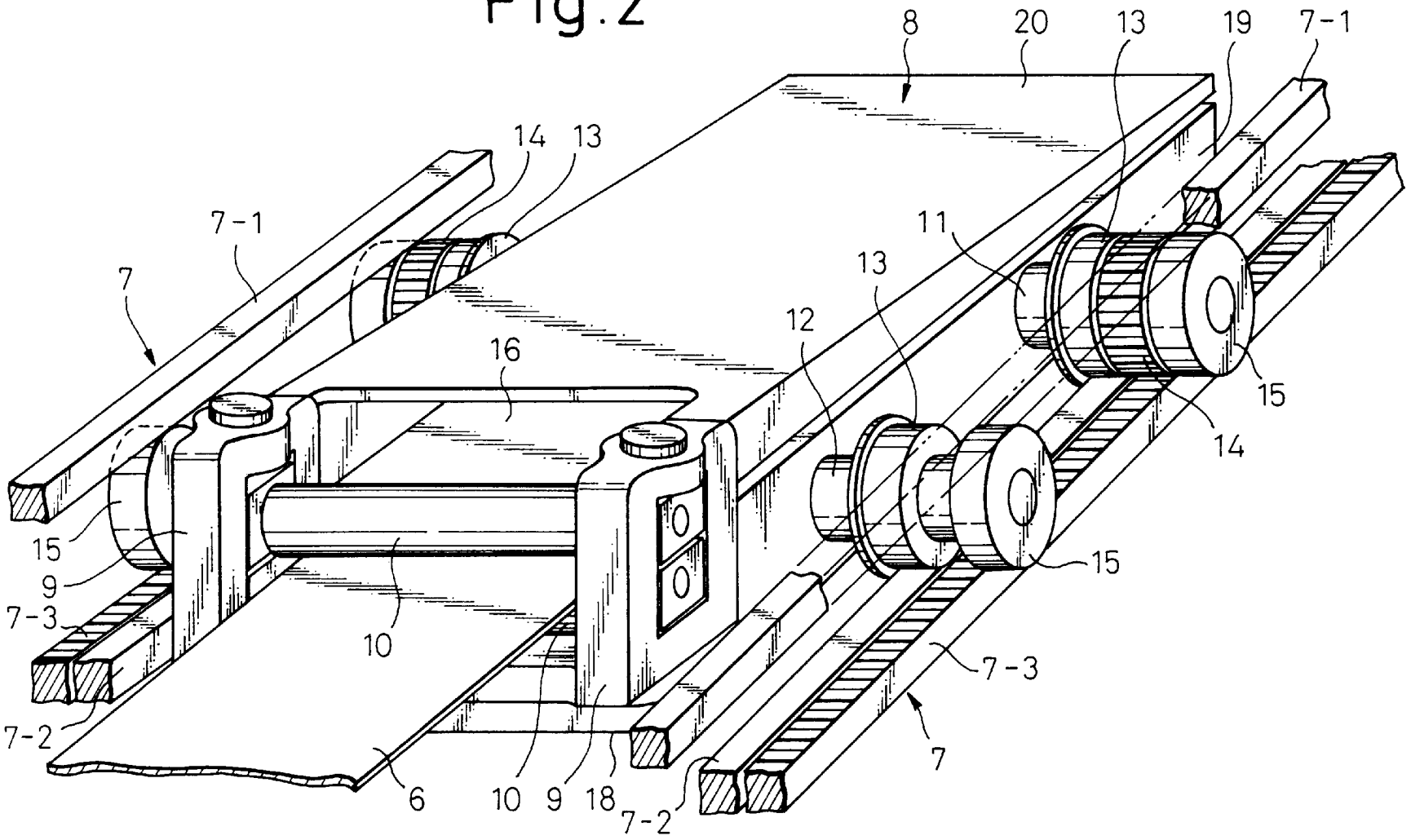
FIG. 2 is a perspective view showing an outline of the strip front-end arresting device of the present invention.
Figure 7:
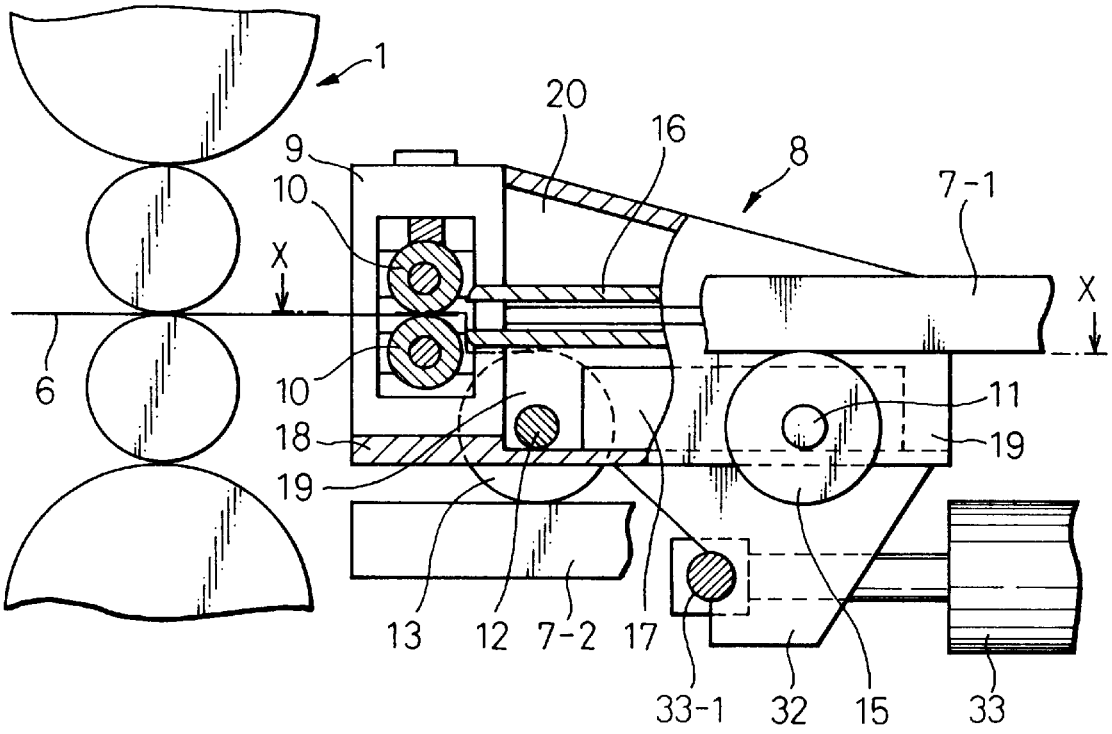
FIG. 7 is a partially cutaway front view of another example of the strip front-end arresting device of the present invention.
Figure 8:
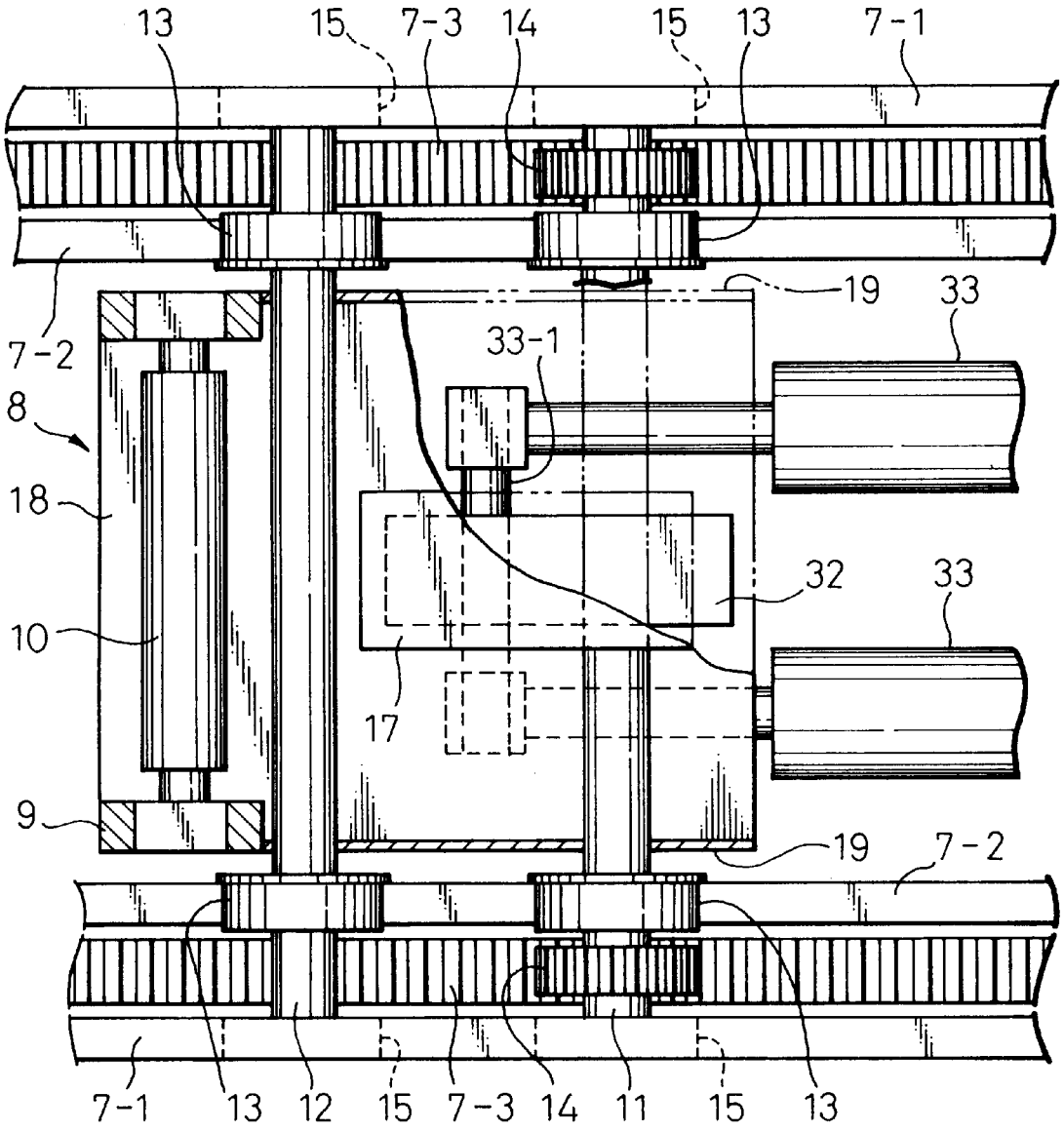
FIG. 8 is a cross-sectional view taken on line X—X in FIG. 7, wherein a portion is omitted.

Referring to FIGS. 2, 7 and 8, the guide rails 7 and the strip front-end arresting device 8 will be explained in detail.

As illustrated in the drawings, the strip front-end arresting device 8 is composed of a running carriage 18 and a carriage body which includes side walls 19 and a cover 20. On the side of the running carriage opposing to the finishing mill 1, there is provided a pair of holding rollers 10, 10 which hold a front-end of the strip 6 sent out from the finishing mill. These holding rollers are mounted on the stands 9, 9 and are rotated by a drive mechanism, not shown in the drawing which is outside of the strip front-end arresting device 8.

In this connection, it is preferable to arrange a strip front-end guide for securely guiding a strip front-end between the holding rollers, at the front position of the strip front-end arresting device 8.

Next, the running mechanism of the strip front-end arresting device will be explained below.

A drive shaft 11 and an idle shaft 12 penetrate the side walls 19, 19. Pinion gears 14, 14 are attached to the ends of the drive shaft 11, and an inner wheel 13 and an outer wheel 15 are rotatably engaged with the drive shaft 11. In the same manner, an inner wheel 13 and an outer wheel 15 are rotatably attached to the ends of the idle shaft 12, so that the inner wheel 13 and the outer wheel 15 can be freely rotated round the idle shaft 12. On the running carriage 18, there is provided a rotary drive unit 17, for example, there is provided an electric motor to rotate the drive shaft 11.

The guide rails 7 include a rail 7-1 to support and guide the inner wheels 13, 13 on the lower side of these wheels, and a rail 7-2 to hold and guide the outer wheels 15, 15 on the upper side of these wheels. Between these rails, there is provided a rack gear 7-3 meshed with the pinion gear 14. There is provided a guide plate 16 at a position close to the holding rollers 10, 10.

Next, the operation of the above apparatus will be explained.

Before the front-end of the strip 6 is sent out from the finishing mill 1, as illustrated in FIG. 1, all pinch rollers 4 and cooling water spraying devices 5 are waiting in such a manner that they are respectively located at positions which are separate upward and downward from the strip running line S. The strip front-end arresting device 8 waits at a position very close to the exit of the final rolling stand of the finishing mill 1 in such a manner that the holding rollers 10 of the strip front-end arresting device 8 are rotated at a circumferential speed a little higher than the running speed of the strip 6 at which the strip 6 is sent out from the finishing mill 1.

After the front-end of the strip 6 has been sent out from the finishing mill 1, the strip front-end arresting device 8 immediately holds the front-end of the strip 6 between the holding rollers 10. Approximately at the same time as that, or a little earlier than that, the strip front-end arresting device 8 starts accelerating toward the down-coiler 2, so that the running speed of the strip front-end arresting device 8 can be increased in a short period of time, and the strip front-end arresting device 8 can run synchronously with the rolling speed of the finishing mill 1.

Figure 3:
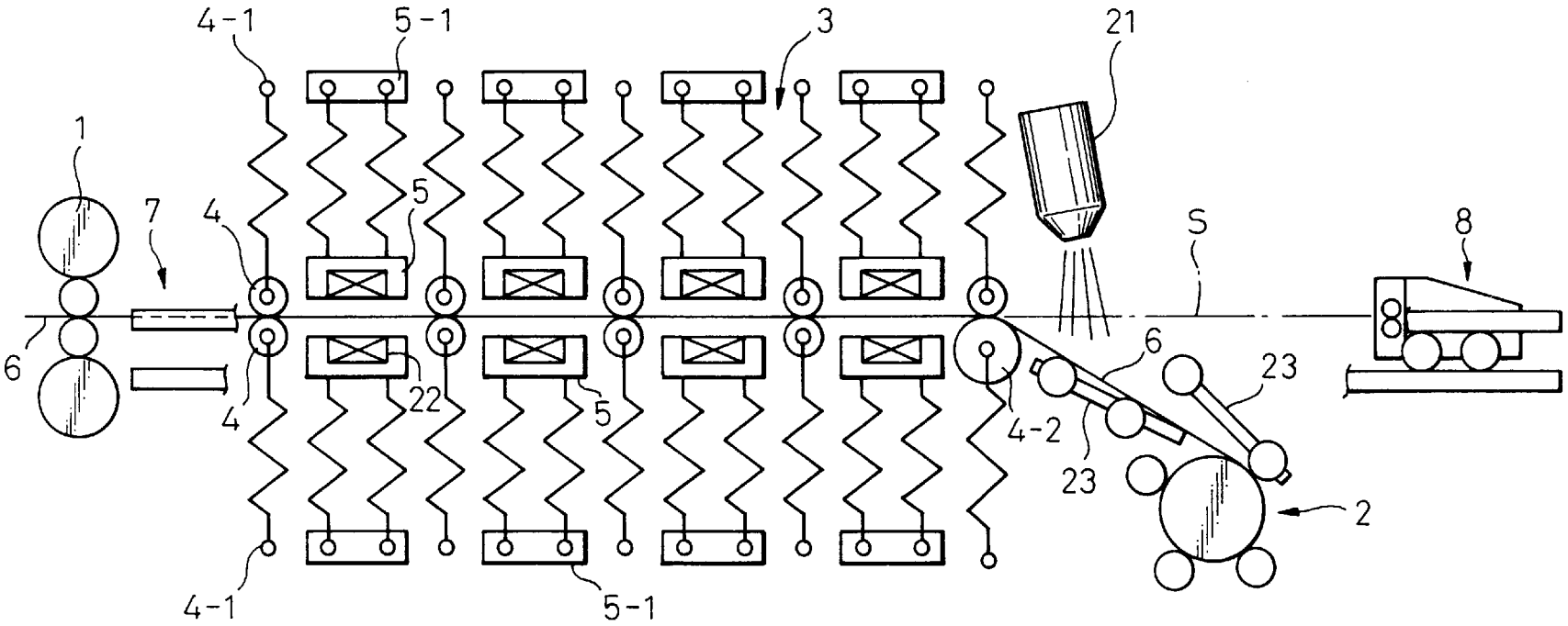
FIG. 3 is a front view showing an outline of the hot strip rolling mill of the present invention in a state after threading a strip onto a strip cooling line.

On the other hand, as illustrated in FIG. 3, the pairs of pinch rollers 4 and cooling water spraying devices 5, which have been retracted in the upper and the lower direction, are moved toward the strip 6 in accordance with the passage of the strip front-end arresting device 8, so that the pairs of pinch rollers 4 and cooling water spraying devices 5 come close to the upper and the lower surface of the strip 6. Then the pinch rollers 4 come into contact with the upper and the lower surface of the strip 6, and the rotational speeds of the pinch rollers 4 are controlled so that an intensity of the tension given to the strip 6 can be maintained in a predetermined range at all times. At this time, the cooling water spraying devices 5 spray cooling water to the upper and the lower surface of the strip 6. In this way, the strip 6 is cooled while it is given an appropriate amount of tension at all times. Accordingly, it is possible to greatly improve flatness of the strip after the completion of cooling. Further, the cooling water spraying devices 5 can be made to be close to or away from the surfaces of the strip 6. Therefore, it is possible to cool the strip quickly because the cooling water spraying devices 5 are made to be close to the surface of the strip 6 after the strip front-end arresting device 8 has passed through the cooling water spraying devices 5. Accordingly, it becomes possible to shorten the length of the cooling line. In addition to that, the thickness of a scale layer generated on the surface of the strip 6 can be reduced. Therefore, it is possible to reduce a load given to the following acid cleaning line.

When a front-end of the strip 6 has arrived at the entrance of the down-coiler 2, a holding force given to the front-end of the strip 6 by the holding rollers 10 of the strip front-end arresting device 8 is released. Due to the foregoing, the strip front-end arresting device 8 is separated from the strip 6 and runs to the end of the guide rail and stops. When the strip front-end arresting device is provided with a brake unit such as a disk brake, or when there is provided a device to give a brake force to the strip front-end arresting device, on the path after the down-coiler, for example, when there is provided a device like a hook to stop a plane landing on an aircraft carrier, it is possible to stop the strip front-end arresting device in a short distance. Therefore, the length of a factory building can be reduced.

On the other hand, in the example illustrated in FIG. 3, at a position close to the entrance of the down-coiler 2, there is provided a fluid jet device 21 to introduce the front-end of the strip 6 into the down-coiler 2. Simultaneously when the strip 6 is disconnected from the strip front-end arresting device, this fluid jet device 21 jets a stream of pressured water, air or nitrogen gas to the front-end of the strip 6 which has been disconnected from the strip front-end arresting device. By the action of this stream of water, air or nitrogen gas, the front-end of the strip 6 is introduced into the entrance of the down-coiler 2. When a velocity component of the fluid which has been jetted out in this way is directed to the strip advancing direction at this time, the strip 6 can be introduced into the entrance of the down-coiler 2 more smoothly.

In this connection, when the strip 6 is coiled round the mandrel of the down-coiler 2, a back-tension is always given to the strip 6 by the pinch rollers 4, so that the strip 6 can be uniformly coiled without looseness. Accordingly, it becomes possible to reduce a running speed of the strip 6 on the strip cooling line 3. Therefore, it is unnecessary to reduce a rolling speed of the tail of the strip while it is rolled by the finishing mill 1.

After the tail of the strip 6 has passed through the pinch rollers 4, no tension is given to the tail of the strip 6. Accordingly, there is a possibility that the tail of the strip 6 swings upward and downward on the cooling table. When electromagnetic force generating devices 22 are incorporated into the cooling water spray devices 5 arranged on both the upper and the lower side, the tail of the strip can be maintained in a more stable condition when it runs on the cooling table. Concerning the above electromagnetic force generating device, it is appropriate to use a device into which an induction coil is incorporated so as to generate an eddy current, and a repulsive force is given by the electromagnetic force generated by the eddy current, so that the strip tail can be stabilized when it is conveyed on the cooling table. After the tail has arrived at the down-coiler 2, it is possible to stabilize the tail of the strip by the action of jet pressure of the fluid jet device 21. Accordingly, it is unnecessary to greatly reduce a conveyance speed of the strip tail.

Figure 4:
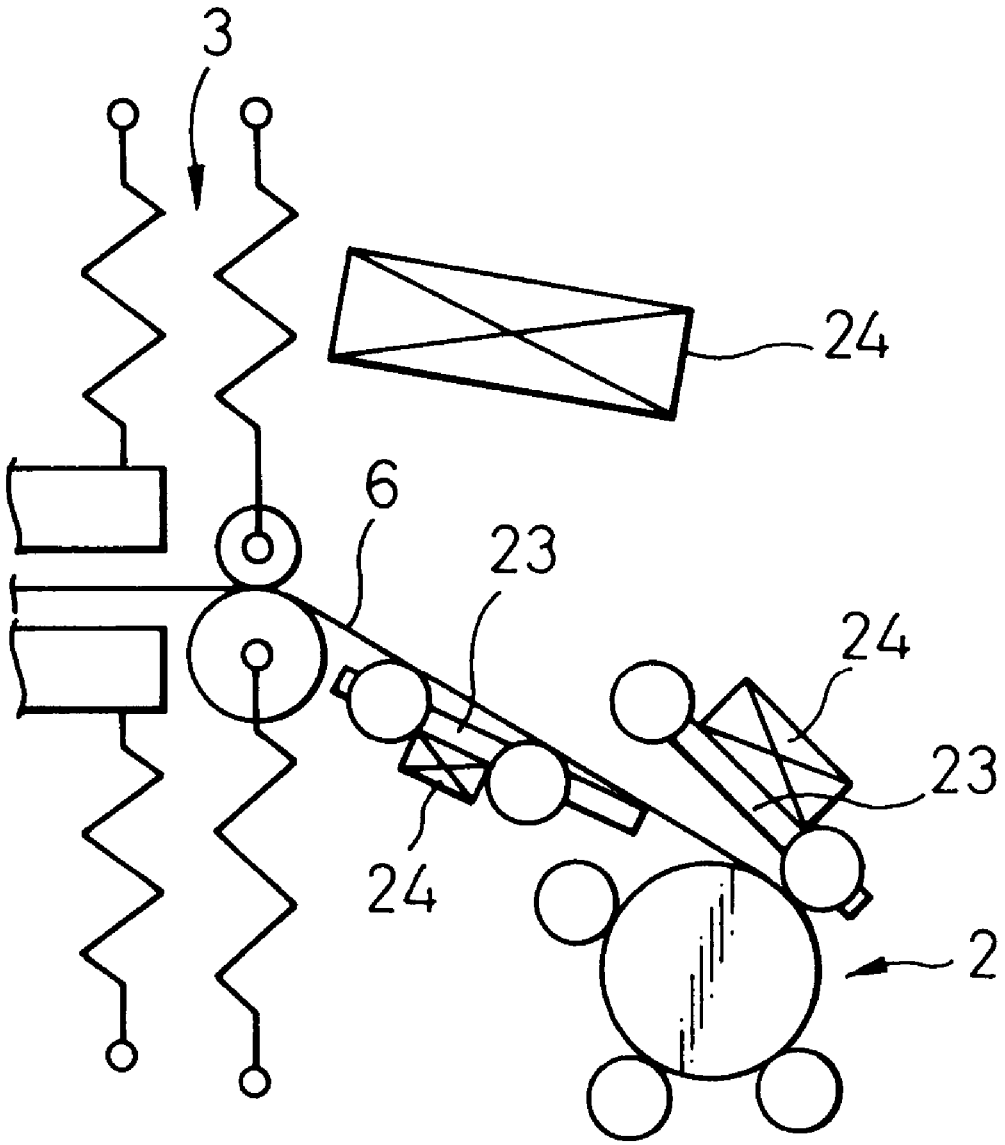
FIG. 4 is a front view showing an outline of the primary portion of an example of the threading stabilization means for stably threading a strip into the down-coiler according to the present invention.

As a stabilizing means for stabilizing the strip when it is introduced into the down-coiler 2, instead of the above fluid jet device 21, an electromagnetic force generating device 24 may be arranged at a position close to the entrance of the down-coiler 2 and also at the guide portion 23 of the down-coiler 2 (shown in FIG. 4).

Figure 5:
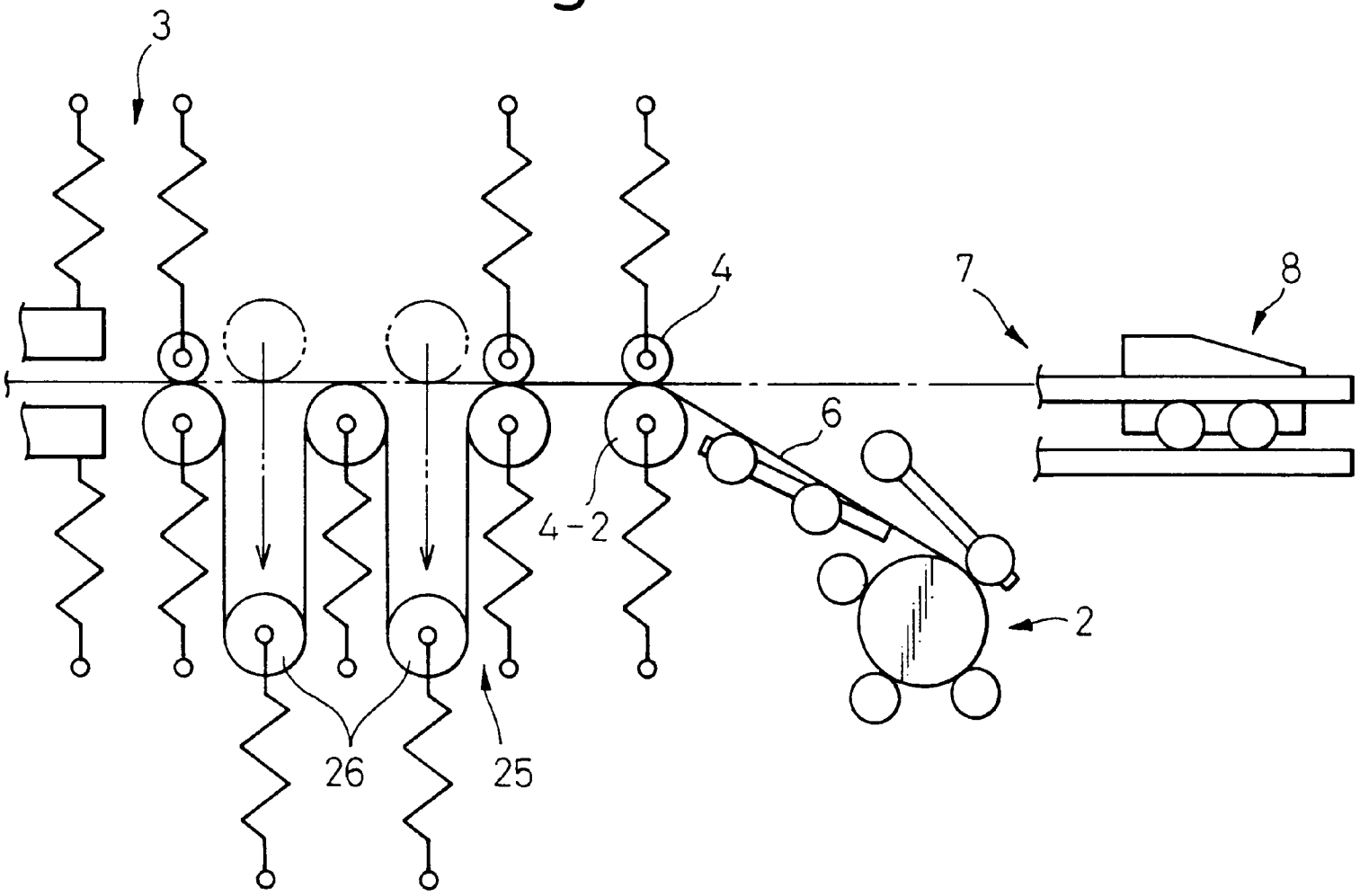
FIG. 5 is a front view showing an outline of the primary portion of another example of the threading stabilization means for stably threading a strip into the down-coiler according to the present invention.

In the case where the above stabilizing means is not used, it is preferable to reduce an introducing speed of the front-end of the strip 6 into the down-coiler 2. As a means for reducing the introducing speed of the strip 6, it is well known to arrange a looper device immediately before the down-coiler 2. As illustrated in FIG. 5, this looper device 25 is composed as follows. There are provided looper rollers 26 capable of moving upward and downward, which push the strip 6 downward, so that portions of the strip 6 can be extended downward while an intensity of tension is maintained at a predetermined value. In this way, the running speed of the front-end of the strip 6 can be temporarily reduced. Operation of this looper device 25 will be briefly explained as follows.

When the pinch rollers 4, 4-2 arranged immediately before the down-coiler 2 hold the strip 6, the rotational speed of the pinch roller 4-2 is reduced without delay, so that the running speed of the front-end of the strip 6 can be reduced. At the same time, a surplus portion of the strip 6, which is conveyed without a decrease in the running speed, is stored in the looper device 25 when the looper rollers 26 are moved downward. Due to the foregoing, the introducing speed of the front-end of the strip 6 into the down-coiler 2 can be reduced. Under the above condition, the strip front-end arresting device 8 is disconnected from the strip 6, and then the strip 6 is coiled round the mandrel of the down-coiler 2. A predetermined intensity of tension is always given to the strip 6, which has been stored in the looper device 25, by the action of the looper rollers 26. When the front-end of the strip 6 is coiled by the down-coiler 2, the rotation of the mandrel is accelerated without delay, and the portion of the strip 6 stored in the looper device 25 is quickly coiled and absorbed by the down-coiler 2. In this way, the surplus portion of the strip 6 is absorbed before the tail of the strip 6 arrives at the looper device 25. Therefore, the tail of the strip 6 can pass through the path stably.

Figure 6:
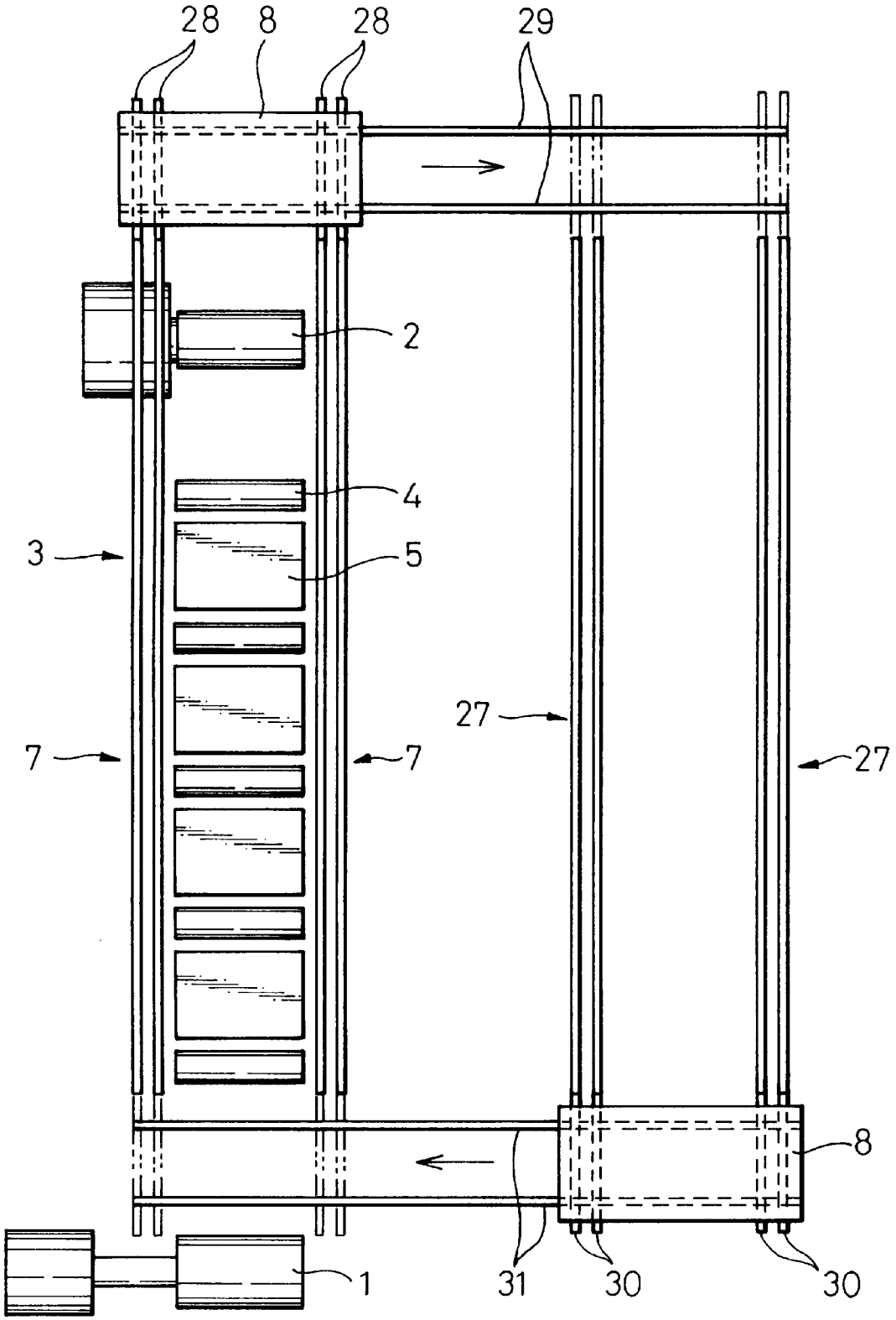
FIG. 6 is a plan view showing an arrangement of the guide rails of the strip front-end arresting device.

In this connection, after one coil has been coiled by the down-coiler 2, in order to prepare for the successive strip, it is necessary to return the strip front-end arresting device 8 to a predetermined position immediately after the finishing mill 1. This returning time is a loss time. In order to avoid the generation of this loss time, the following arrangement may be adopted. As illustrated in FIG. 6, in parallel with the guide rails 7 arranged in the strip cooling line, there are provided guide rails 27 exclusively used for returning the strip front-end arresting device 8. At the start portions and the end portions of the two sets of guide rails 7, 27, short rails 28, 30 are respectively connected, on which the strip front-end arresting device 8 can be put. There are provided transverse rails 29, 31 to which the short rails 28, 30 can be freely moved in the transverse direction.

Due to the foregoing arrangement, two sets of strip front-end arresting devices 8 are alternately moved in the transverse direction in conjunction with the short rails 28, 28. Due to the above arrangement, it is possible to realize preparation for the successive coil without generating a loss time as follows. While one of the strip front-end arresting devices 8 is running on the guide rails 7, the other strip front-end arresting device 8 is made to run on the guide rails 27 exclusively used for returning the strip front-end arresting device 8, so that the strip front-end arresting device is returned onto the side of the finishing mill 1. When the tail of the coil has passed and the pinch rollers 4 and the cooling water spraying devices 5 have been opened upward and downward, the strip front-end arresting device that has already returned to the start portion is moved in the transverse direction in conjunction with the short rails 30 arranged on the start end side, and the strip front-end arresting device is aligned with the guide rails 7 of the strip cooling line 3. One of the strip front-end arresting devices, which has already run to the end of the strip cooling line 3, is moved in the transverse direction in conjunction with the short rails 28 arranged on the end portion side. Then the strip front-end arresting device is aligned with the guide rails 27 exclusively used for returning the strip front-end arresting device 8.

In this connection, the strip front-end arresting means is not limited to the holding rollers 10 described in the above example. For example, a jaw type clamp device may be used as the strip front-end arresting means.

In the example explained above, the strip cooling line includes cooling water spraying devices which are capable of moving upward and downward and pinch rollers which are capable of moving upward and downward. However, it should be noted that the arrangement of the strip cooling line is not limited to the above specific example, for example, the conventional cooling line composed of a run-out table and a cooling device may be adopted. In this case, there are provided guide rails at upper portions on both sides of the run-out table, and a strip front-end arresting device holding a strip front-end is made to run on these guide rails. In this arrangement, since a strip front-end is held by the holding rollers of the above device, when the above device runs on the run-out table, a strip hanging down from the above device runs on the run-out table while it is being cooled.

Even in the above case, it is possible to thread a strip at high speed without causing a flying phenomenon at the front-end of the strip. Accordingly, the productivity of the hot strip rolling mill can be enhanced.

In this connection, the cooling water spraying device may be arranged in an upper portion of the run-out table in such a manner that it can be moved upward and downward, and after the strip front-end arresting device has passed through on the run-out table, the cooling water spraying device may be moved so that it can approach the strip.

The following are explanations of the means for giving a predetermined acceleration to the strip front-end arresting device when it runs. After the strip 6 has been rolled, it is sent out from the finishing mill 1 at a speed not lower than 1000 m/min. Accordingly, in order to hold the front-end of the strip by the strip front-end arresting device of the present invention and make it run synchronously with the strip running speed, it is preferable to give a high initial acceleration to the above device from the outside.

For example, on the assumption that the total weight of the strip front-end arresting device 8 is 5 tonf and the running speed of the strip sent out from the finishing mill 1 is 1200 m/min, when the front-end of the strip 6 arrives at a position before the holding roller 10 of the strip front-end arresting device 8 by the distance of 0.5 m, the strip front-end arresting device 8 is given an initial acceleration by the thrust of 25 tonf generated by the auxiliary drive device, and at the same time the running carriage 18 is made to run via the pinion gear 14 that is driven by a power of 500 kW. Then the running carriage 18 runs while the wheels 13, 15 of the running carriage 18 are restricted by the upper and the lower guide rail 7 so that it can not be raised upward, and the running speed reaches 1200 m/min after 0.41 sec. At this time, the strip front-end arresting device 8 advances by the distance of about 4.08 m, and the front-end of the strip 6 reaches a position protruding from the holding roller 10 by the distance of 3.58 m, and the strip front-end arresting device 8 runs while a tension which is 1 tonf per unit width of 1 m is given to the strip.

As explained above, by adopting the external auxiliary drive device, the weight of the strip front-end arresting device 8 can be decreased compared with the case that all of the necessary drive system is mounted on the front-end arresting device. Therefore, the strip front-end arresting device 8 can be quickly accelerated as described above.

Referring to FIGS. 7 and 8, an example of the above auxiliary drive device will be explained below.

As illustrated in the drawing, there is provided a hook 32 on the lower surface of the running carriage 18 of the strip front-end arresting device 8. This hook 32 is engaged with rod end portions 33-1 of the air cylinders 33, 33. These air cylinders 33, 33 are arranged inside the guide rails 7, 7 on the floor.

At the initial acceleration, the air cylinders 33, 33 are contracted, and the hook 32 is quickly pulled via the rod end portions 33-1, so that the strip front-end arresting device 8 is given an initial acceleration. As described above, the air cylinder units 33, 33 are used as the auxiliary drive device. Therefore, in order to accumulate a large quantity of compressed air in an accumulator, all the time except for the acceleration time can be utilized for accumulating compressed air in the accumulator. Therefore, it is possible to use an air compressor of small capacity. In this way, it is possible to obtain a strong and stable drive force at low cost.

As described above, after the completion of acceleration, the running speed of the strip front-end arresting device 8 becomes constant being synchronized with the rolling speed. At this time, the strip front-end arresting device 8 is running while it gives a tension of 1 tonf per unit width of 1 m to the strip 6. In this case, when the running speed of the strip front-end arresting device 8 is made to be a little higher than the rolling speed, the strip front-end arresting device 8 can be moved in the direction of the front-end portion of the strip 6 which protrudes to the front from the holding rollers 10. In other words, the front-end of the strip can be returned in the direction of the holding rollers. Due to the foregoing, the holding rollers 10 are rotated slowly, and a relative position between the front-end of the strip 6 and the strip front-end arresting device 8 is changed. Accordingly, when the running speed of the strip front-end arresting device 8 is appropriately adjusted so as to change a contact position of the holding roller 10 with the strip 6, it is possible to prevent the occurrence of uneven abrasion of the holding roller 10 and the local undercooling of the strip 6, and at the same time it becomes possible to quickly disconnect the strip front-end arresting device 8 from the strip 6 when it has reached the down-coiler 2. At this time, for example, when the drive torque of the holding rollers 10 is controlled so that the predetermined intensity of tension can be always given to the strip 6, the rotational speed of the holding rollers 10 is automatically determined in accordance with a relative speed between the strip front-end arresting device 8 and the strip 6.

Next, referring to FIG. 9 and FIGS. 10(A) to 10(D), an example of the strip front-end transfer device will be explained below, by which the strip front-end is smoothly transferred from the holding rollers 10, 10 of the strip front-end arresting device 8 to the down-coiler 2.

Figure 9:
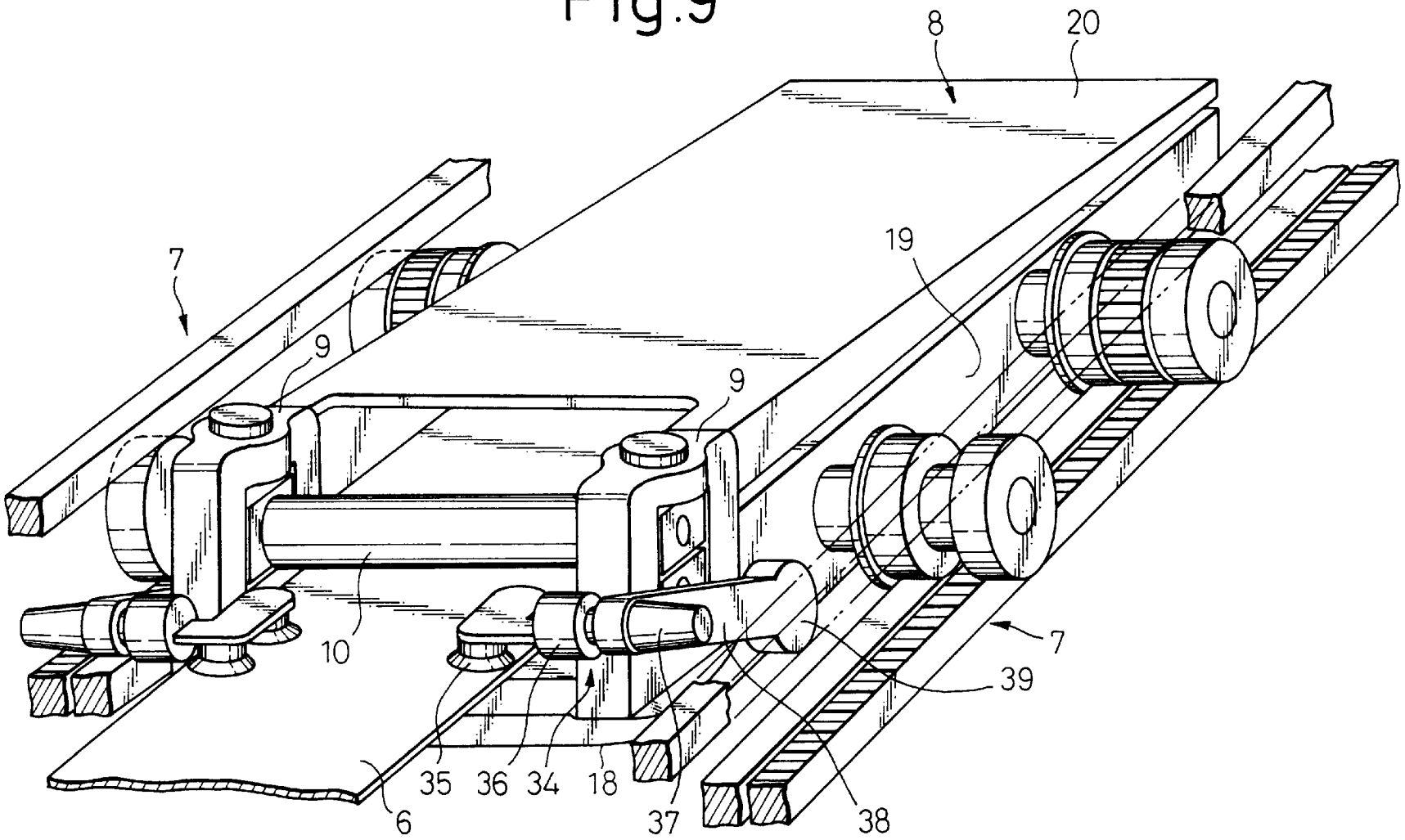
FIG. 9 is a perspective view showing an outline of another example of the strip front-end arresting device of the present invention.

As illustrated in FIG. 9, there is provided a strip support arm 38, to one end of which a strip edge portion holding device 34 is attached. The strip edge portion holding device 34 includes a holding board 35 such as an electromagnet or a suction cup which holds an edge portion of the strip 6, wherein the holding board 35 is attached to one end of the strip edge portion holding device 34, an interval adjusting device 37 to move the holding board 35 in accordance with the strip width, wherein the interval adjusting device 37 is attached to the other end of the strip edge portion holding device 34, and an angle control device 36 to maintain the strip held by the holding board 35 in a horizontal condition, wherein the angle control device 36 is attached to the middle portion of the strip edge portion holding device 34. A rotational mechanism 39 to rotate the strip support arm 38 is attached to the other end of the support arm 38.

The above rotational mechanism 39 includes a rotational shaft (not shown) penetrating the wall 19 of the strip front-end arresting device 8, and an electric motor (not shown) to rotate this rotational shaft, wherein the rotational shaft and the electric motor are arranged inside the strip front-end arresting device 8.

The above devices are provided in both edge portions of the strip.

Figure 10A:
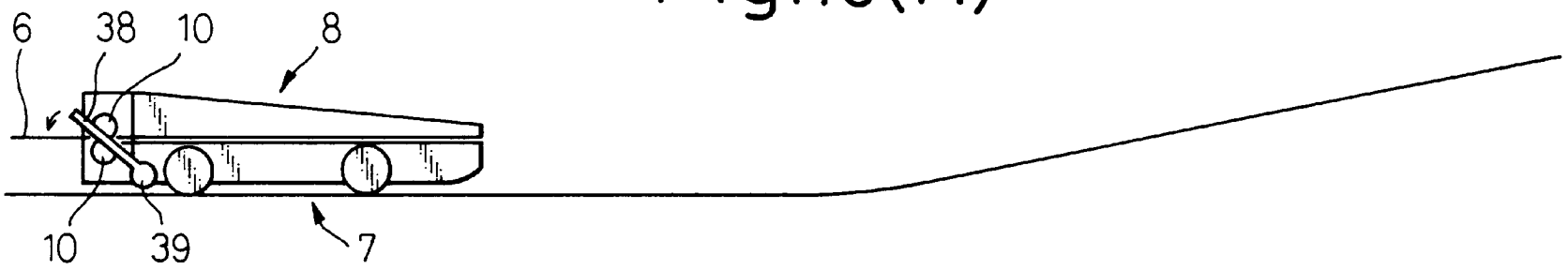
FIGS. 10(A), 10(B) and 10(C) are schematic illustrations showing a state of holding the edge portions of a hot strip by the strip front-end arresting device illustrated in FIG. 9, wherein these schematic illustrations show a change with time.
Figure 10B:
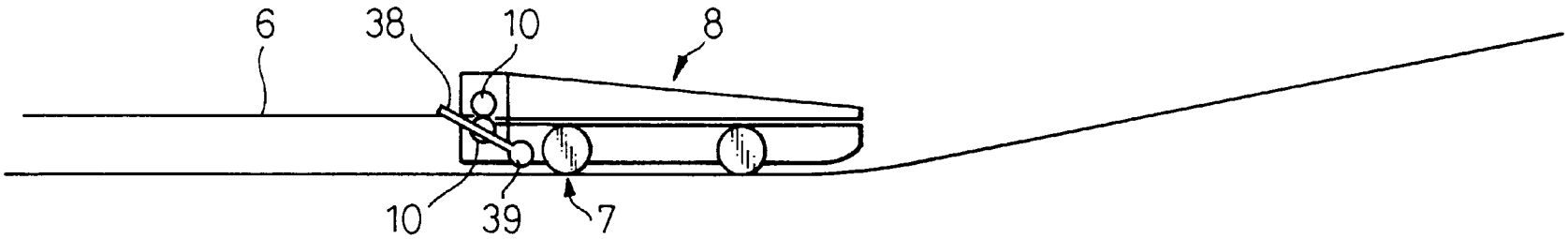
Figure 10C:
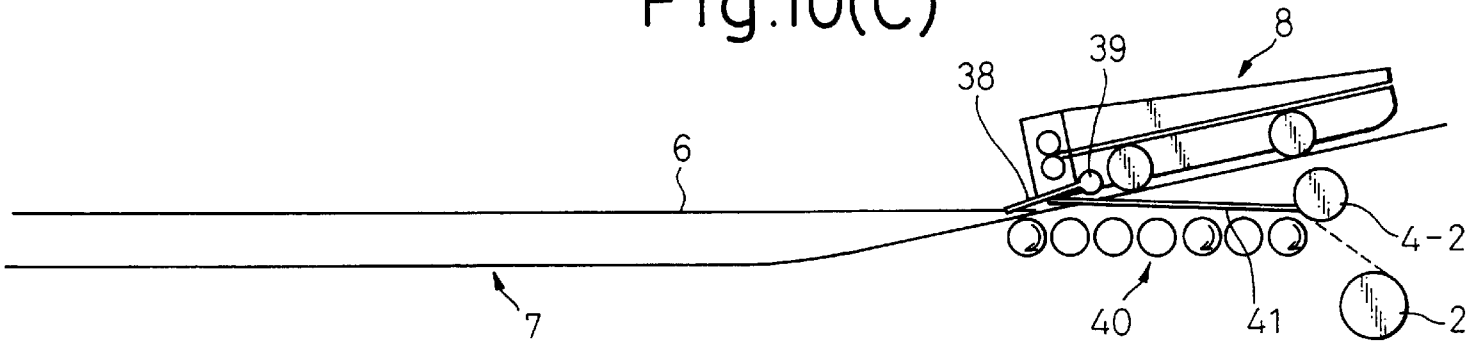
Figure 10D:
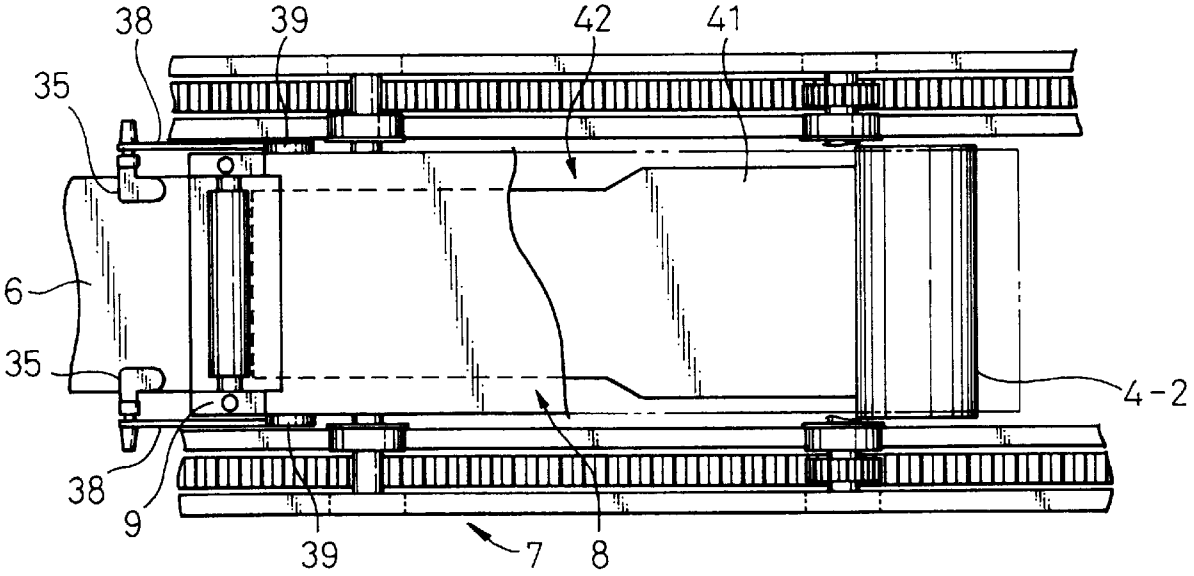
FIG. 10(D) is a partially sectional plan view of FIG. 10(C).

As illustrated in FIGS. 10(C) and 10(D), on the entry side of the down-coiler 2, there are provided table rollers 40 before the coiler, and a pinch roller 4-2. Further, in the upper portion of the table roller 40, there is provided an upper surface guide plate 41 having a cutout portion 42 through which the strip edge holding device 34 can pass while it is holding a front-end of the strip.

The above strip front-end transfer device is operated as follows.

As illustrated in FIG. 10(A), after the holding rollers 10, 10 of the strip front-end arresting device 8 have held the front-end of the strip 6, the strip front-end arresting device 8 runs on the guide rails 7, the middle portion of which is an up-grade, at a speed a little higher than the strip running speed, so that the strip front-end, which has gone ahead of the holding rollers 10, 10 in the initial acceleration of the strip front-end arresting device 8, is gradually pulled back to the holding roller side. Next, as illustrated in FIG. 10(B), immediately before the strip front-end comes out from the holding rollers 10, 10, that is, immediately before the strip front-end arresting device 8 reaches the up-grade portion of the guide rails 7, the strip support arms 38 are rotated by the rotational mechanisms 39 toward the strip edges, so that the holding boards 35 can hold the edge portions of the strip. After that, the holding rollers 10, 10 are opened, and the strip front-end is pulled out from the holding rollers.

Next, as illustrated in FIG. 10(C), the strip front-end arresting device 8 ascends along the guide rails of the up-grade, and the strip support arms 38 are further rotated, so that the strip front-end is made to approach the table rollers 40 before the down-coiler. The strip holding boards 35 hold the edge portions of the strip through the cutout portions of the upper surface guide plate 41 immediately before the pinch roller 4-2, and the strip holding boards 35 release the strip front-end immediately before the end portions of the cutout portions.

The strip front-end is sent to the pinch roller 4-2 by the rotation of the table rollers 40 while the upper portion of the strip front-end is being restricted by the upper surface guide plate 41.

According to the above apparatus, the strip is coiled by the down-coiler 2 very smoothly. Since the strip front-end arresting device 8 ascends along the path of the up-grade, it is possible to stop the strip front-end arresting device 8 in a short distance even if a relatively low brake force is applied to it. Accordingly, it is possible to shorten the length of the production line.

INDUSTRIAL APPLICABILITY

As described above, according to the present invention, while the strip front-end is mechanically constrained by the strip front-end arresting device after it has been sent out from the finishing mill, the strip front-end arresting device runs at a speed synchronized with the sending speed of the finishing mill. Accordingly, it is possible to thread the strip on the cooling line while a predetermined tension is given to the strip. Due to the foregoing, it is possible to prevent the occurrence of flying and snaking over the entire length of the strip. Therefore, it is possible to increase the threading speed of the cooling line in accordance with the capacity of the finishing mill. Consequently, it is possible to enhance the productivity and reduce the equipment cost greatly.

When the cooling water spraying devices and the pinch rollers are arranged in such a manner that they can be moved upward and downward, it is possible to give a predetermined tension to the overall length of the strip when it is cooled. Further, when the cooling water spraying devices are made to move to positions close to the strip, the cooling efficiency can be enhanced. Accordingly, the strip can be uniformly cooled over the entire length, and the strip quality can be enhanced.

We claim:

1. A hot strip rolling mill comprising a hot finishing mill, a strip cooling line installed on a delivery side of the hot finishing mill, and a down-coiler installed on a delivery side of the strip cooling line;

characterized by comprising a strip front-end arresting device equipped with at least one pair of upper and lower rotating drive members for providing constant torque control or braking and for pinching a strip front-end, the strip front-end arresting device being installed on the strip cooling line to pinch the strip front-end by the rotating drive members and to run from the hot finishing mill to the down-coiler while imparting tension to the strip.

2. A hot strip rolling mill according to claim 1, wherein the rotating drive members for providing constant torque control or braking are a pair of upper and lower pinch rollers.

3. A hot strip rolling mill comprising a hot finishing mill, a strip cooling line installed on a delivery side of the hot finishing mill, and a down coiler installed on a delivery side of the strip cooling line, characterized by comprising:

a strip front-end arresting device equipped with at least one pair of upper and lower rotating drive members for providing constant torque control or braking and for pinching a strip front-end, the strip front-end arresting device being installed on the strip cooling line to pinch the strip front-end by the rotating drive members and to run from the hot finishing mill to the down-coiler while imparting tension to the strip, and pinch rollers and cooling water spraying devices mounted for retraction from a course along which the strip front-end arresting device moves while the strip front-end arresting device passes through on the strip cooling line, and for coming to positions where they can contact an upper and a lower surface of the strip after the strip front-end arresting device has passed through the strip cooling line.

4. A hot strip rolling mill comprising a hot finishing mill, a strip cooling line installed on a delivery side of the hot finishing mill, and a down-coiler installed on a delivery side of the strip cooling line, characterized by comprising a strip front-end arresting device equipped with at least one pair of upper and lower pinch rollers for pinching a strip front-end, the strip front-end arresting device being installed on a strip cooling line to pinch the strip front-end by the pinch rollers and to run from the hot finishing mill to the down-coiler while imparting tension to the strip and being equipped with a running carriage mounted for movement on the strip cooling line from the finishing mill side to the down-coiler side at a speed synchronized with strip rolling speed.

5. A hot strip rolling mill according to claim 4, further comprising an electromagnetic force generating device for making the strip run stably along the strip cooling line.

6. A hot strip rolling mill according to claim 4, further comprising an electromagnetic force generating device for making the strip run stably along the strip cooling line and an electromagnetic force generating device or a fluid jet device installed at a coiling start position of the down coiler for guiding the strip into an entrance of the down-coiler.

7. A hot strip rolling mill comprising a hot finishing mill, a strip cooling line installed on a delivery side of the hot finishing mill, and a down-coiler installed on a delivery side of the strip cooling line, characterized by comprising:

a strip front-end arresting device equipped with at least one pair of upper and lower pinch rollers for pinching a strip front-end, the strip front-end arresting device being installed on the strip cooling line to pinch the strip front-end by the pinch rollers and to run from the hot finishing mill to the down-coiler while imparting tension to the strip, a running carriage mounted for movement on the strip cooling line for enabling the strip front-end arresting device to run from the finishing mill side to the down-coiler side at a speed synchronized with strip rolling speed, guide rails for guiding the running carriage, wheels and wheel driving devices for moving the running carriage along the guide rails, strip edge portion holding devices for holding both edge portions of the strip installed on side walls of the strip front-end arresting device, a strip width adjusting device for adjusting spacing between the holding devices in accordance with the width of the strip, angle controlling devices for maintaining the strip horizontal, and rotatable strip edge supporting devices included in the holding devices, the strip width adjusting device and the angle controlling devices mounted thereon and equipped with strip edge supporting arms, and a looper device installed near the down-coiler at its entry side.

8. A hot strip rolling mill comprising a hot finishing mill, a strip cooling line installed on a delivery side of the hot finishing mill, and a down-coiler installed on a delivery side of the strip cooling line, characterized by comprising, a strip front-end arresting device, installed on the strip cooling line, which is equipped with at least one pair of pinch rollers for pinching a strip front-end, guide rails installed along a strip running line to have an uphill slope in the vicinity of the down-coiler, wheels for movement and driving devices for driving the wheels and said strip front-end arresting device being equipped for pinching the strip front-end by the pinch rollers and running from the hot finishing mill to the down-coiler while imparting tension to the strip, a running carriage mounted for movement on the strip cooling line to run from the finishing mill side to the down-coiler side at a speed synchronized with strip rolling speed, an auxiliary drive device installed between the guide rails for imparting an initial acceleration to the strip front-end arresting device, short guide rails provided at the delivery side of the hot finishing mill and at the delivery side of the strip cooling line, and return guide rails for returning the strip front-end arresting device provided in parallel with the guide rails, and an upper surface guide plate having a cutout portion installed below the guide rails and above table rollers installed ahead of the down-coiler along the strip running line.

* * * * *